US007644990B2

(12) United States Patent
Pearson

(10) Patent No.: US 7,644,990 B2
(45) Date of Patent: Jan. 12, 2010

(54) BODY SUPPORT DEVICE FOR SLEEPING IN A SEATED POSITION

(76) Inventor: Jon D. Pearson, 17112 Spring Hollow Ct., Mt. Airy, MD (US) 21771

( * ) Notice: Subject to any disclaimer, the term of this patent is extended or adjusted under 35 U.S.C. 154(b) by 841 days.

(21) Appl. No.: 11/381,184

(22) Filed: May 2, 2006

(65) Prior Publication Data

US 2007/0256692 A1 Nov. 8, 2007

(51) Int. Cl.
*A47G 9/00* (2006.01)
*A47C 1/10* (2006.01)

(52) U.S. Cl. ..... 297/393; 5/633; 5/640; 5/636; 297/219.12; 297/411.25

(58) Field of Classification Search ..... 5/633, 5/636, 630, 632, 640; 297/397, 219.12, 422.25, 297/464

See application file for complete search history.

(56) References Cited

U.S. PATENT DOCUMENTS

| | | | | | |
|---|---|---|---|---|---|
| 2,795,802 | A | | 6/1957 | Myers | |
| 2,961,668 | A | * | 11/1960 | Hayes | 5/640 |
| 3,017,221 | A | | 1/1962 | Emery | |
| 3,840,916 | A | * | 10/1974 | Jennings | 5/655 |
| 4,173,048 | A | | 11/1979 | Varaney | |
| 4,617,691 | A | | 10/1986 | Monti | |
| 4,688,282 | A | | 8/1987 | Jeffries | |
| 4,776,049 | A | | 10/1988 | Perron | |
| 5,027,457 | A | * | 7/1991 | Sweet | 5/640 |
| D376,503 | S | | 12/1996 | Petersson | |
| 5,586,351 | A | | 12/1996 | Ive | |
| D420,845 | S | | 2/2000 | Rumage | |
| 6,052,848 | A | | 4/2000 | Kelly | |
| 6,088,854 | A | | 7/2000 | Brownrigg | |
| 6,216,298 | B1 | * | 4/2001 | Oliveira | 5/636 |
| 6,922,860 | B2 | | 8/2005 | Cuddy | |
| 6,951,367 | B1 | | 10/2005 | Dinnan | |

FOREIGN PATENT DOCUMENTS

| | | |
|---|---|---|
| JP | 2002238704 | 8/2002 |

* cited by examiner

*Primary Examiner*—Alexander Grosz
(74) *Attorney, Agent, or Firm*—Thomas T. Aquilla

(57) ABSTRACT

A personal support apparatus for supporting the head and body of a person sleeping in a seated position includes a generally U-shaped collar member for contacting the wearer's neck from the back, with the collar being made from a soft resilient material that retains its shape, and first and second side arm support members permanently or reversibly and adjustably attached to the collar, with the side arm support members being made from a soft malleable material that reversibly conforms to the contours of the passenger's body and/or the vehicle seat or other surface, the first and second side arm support members being characterized by a first level of firmness, and the collar member being characterized by a second level of firmness that is greater than the first level of firmness.

18 Claims, 4 Drawing Sheets

BODY SUPPORT DEVICE FOR SLEEPING IN A SEATED POSITION

BACKGROUND OF THE INVENTION

1. Field of the Invention

The invention pertains to the field of bedding. More particularly, the invention pertains to a personal support apparatus that cradles the head and body for comfortably supporting a person sleeping in a seated position, such as a passenger in a motor vehicle, airplane, train, or even seated upright in bed, and aids in keeping the wearer from falling to one side or another while sleeping.

2. Description of Related Art

Many times the passenger in a vehicle, such as an automobile, airplane, or train, for example, will fall asleep or want to fall asleep. One problem is that seats generally are not designed for sleeping. Most passengers who sleep in automobiles, airplanes, or trains, are seated in an upright position or a reclined seated position. However, these positions do not lend themselves to sleeping on the side or the stomach, leaving sleeping on the back as the optimal choice. While sleeping in a seat, the passenger's body is unsupported and thus tends to slump to one side.

Many devices that are intended to aid a passenger's comfort, while sleeping in an upright seated position, rely on the assumption that the passenger can find a comfortable sleep in any position, including lying on their side. However, because most seats do not recline fully, sleeping on the back is most practical. One problem with sleeping on the back in a partially-reclined position is that the body has a tendency to slump to the side, causing discomfort.

There are a number of already existing devices that are intended to aid in providing support for sleeping while seated in an upright seated position. Some such devices are intended to, for example, support the person's neck, such as disclosed in U.S. Pat. No. 4,776,049 to Perron, U.S. Pat. No. 4,617,691 to Monti, and U.S. Pat. No. 6,973,691 to Cordova. Other such devices attempt to support various parts of the body, such as disclosed in U.S. Pat. No. 6,951,367 to Dinnan and U.S. Pat. No. 6,922,860 to Cuddy.

U.S. Pat. No. 6,922,860 to Cuddy U.S. Pat. No. 6,951,367 to Dinnan discloses an apparatus for supporting the head of user while the user is lying in a face-down position, a face-up position or a side position. The apparatus includes a head cradle with ventilation and a pair of elongated dependent arms that can be manipulated to serve as a chest support, or a neck support or a head support, depending on how the user is lying. This apparatus does not teach a U-shaped collar and is not suitable to support the body in a seated position.

U.S. Pat. No. 6,951,367 to Dinnan discloses a vehicle seat pad having a first head support and a second head support that are adjustably attached to an upper portion of an elongated pad. Leg support is provided at a lower portion of the elongated pad, by positioning a portion of the elongated pad over another portion of elongated pad. Pillows may inserted in pockets in the elongated pad to provide additional leg support or to provide additional head support. The elongated pad may be rolled, with straps provided to allow the device to be carried on the back. This apparatus does not teach side arms that cradle the body.

U.S. Pat. No. 6,088,854 to Brownrigg discloses a pillow designed to support various portions of the body, either in the prone or sitting position. The preferred embodiment primarily comprises a singular hollow flexible tube filled with a malleable substance, allowing flexibility at all points along the tube, and having sufficient firmness to provide support for the desired portion of the body. This apparatus does not teach any structural neck support.

U.S. Pat. No. 6,052,848 to Kelly discloses a body support pillow stuffed with a resilient deformable filler, having a U-shaped central section and depending legs, the pillow having a center opening equal to the body width of a user. In a first embodiment, the pillow's total length is substantially equal to the height of a user, and the legs are selectively foldable over one another to create a double thickness for additional support under the user's knees, with a detachable body-encircling strap securing the pillow about the user. In a second embodiment for use in a chair, the legs support the arms of a user, and may be raised by rotating them 90 degrees. In a third embodiment, the interior of the pillow is divided by sewn-in baffles into three separately stuffable compartments, all accessible through a single continuous zipper opening. None of the foregoing embodiments teach a collar member for supporting the head and neck.

U.S. Pat. No. D420,845 to Rumage discloses an ornamental design for a neck support pillow having a substantially U-shaped configuration.

U.S. Pat. No. 5,586,351 to Ive discloses a support adjustable pillow adapted to engage an infant's head, neck and shoulders in order to provide lateral stability to the infant's head and neck. The support article broadly comprises a pad having a first surface upon which the infant can be placed in a reposed position and an opposite second surface. An upstanding support pillow is secured to the pad and includes a central portion extending in an arcuate configuration around a region that is sized and adapted to receive the infant's head and a pair of end portions disposed on opposite ends of the central portion. The end portions project in laterally outward directions from one another to define shoulder supports that are positioned against the infant's shoulders, when the infant's head is received around the region. The central portion and the end portions provide stability to the head and neck during use. First and second pairs of cooperative fasteners may be provided so that the support article is adjustable in order to accommodate the size of the infant as he/she grows.

U.S. Pat. No. D376,503 to Petersson discloses an ornamental design for a cushion having a substantially U-shaped configuration and a larger neck and head support area.

U.S. Pat. No. 4,688,282 to Jeffries discloses child's bedding having a flat, generally rectangular blanket portion. A pair of spaced-apart straps are attached to the top edge of the blanket. The straps are adjustable both vertically as well as laterally. A plurality of fasteners permit alternate rows of fasteners to be engaged, thereby allowing the bedding to adjust to different size children. A sewn-in pleat further adds to adjustability by allowing the bedding to be lengthened. Fasteners at the bottom of the bedding provide warmth and keep the child from kicking off the bedding. Lastly, a centrally disposed fastener provides a means to secure the child in a maximum vertical position.

U.S. Pat. No. 4,173,048 to Varaney discloses a pillow having a central head supporting portion with two extension portions, substantially perpendicular to the central portion, providing a sleeper-encircling pillow incorporating built-in arm rests and blanket or sheet slip-prevention means. In the preferred embodiment, the pillow comprises a substantially uniform cross-sectional area throughout its entire length, with easily accessible, firm, supportive filler material disposed within an enclosing cover in order to allow the amount of filler material to be adjustable to one's particular needs.

U.S. Pat. No. 3,017,221 to Emery discloses a head and neck support pillow.

U.S. Pat. No. 2,795,802 to Myers discloses a pillow having a substantially U-shaped configuration.

Japanese Pat. No. JP 2002238704 to Miyazaki discloses a cover for a chair for lessening the fatigue in seating for a long time. The seat cover is designed to be put on a seat of a vehicle and is provided with a low-repulsion cushion near a segment where the back of a person sitting on the seat is located, and a padded backrest section of the seat located apart, when the person sits on the seat, and a low-repulsion cushion near a segment where the neck of the person sitting on the seat and the head rest of the seat are located apart respectively. Titanium worked to the prescribed shapes is incorporated into these low-repulsion cushions. Shoulder straps for covering portions of the shoulder and chest of the person sitting on the seat are integrally formed at the seat cover, so as to be made continuous with a padded backrest cover section.

Although there are known devices that are intended to aid in supporting a person's neck and/or various other parts of the body of a person, while in a seated position, one problem with the prior art devices is that these devices are not well-suited for keeping the person from slumping to one side, or for supporting the head and neck. Thus, the known devices do not allow the passenger to be comfortable and secure, while sleeping in a seated position.

Thus, there is a need in the art for a personal support device that keeps the wearer from slumping to one side, while supporting the head and neck, and allowing a passenger seated in a vehicle to be comfortable and secure, while sleeping in a seated position.

SUMMARY OF THE INVENTION

The present invention provides an adjustable device for supporting the head and body of a person sleeping, while seated in an upright or semi-reclined position, such as a passenger in a motor vehicle. The apparatus according to the invention cradles the head and body, allowing the passenger to be well-supported and thus comfortable and secure, while sleeping in the upright or semi-reclined position.

Briefly stated, the invention provides a personal support apparatus for supporting the head and body of a person sleeping in a seated or semi-reclined position that includes a generally U-shaped collar member for contacting the passenger's neck from the back, with the collar being made from a soft resilient material that retains its shape, and first and second side arm support members permanently or reversibly and adjustably attached to the collar, with the side arm support members being made from a soft malleable material that reversibly conforms to the contours of the wearer's body and surrounding surfaces, such as the interior of a vehicle or airplane. The first and second side arm support members preferably being characterized by a first level of firmness, and the collar member preferably being characterized by a second level of firmness that is greater than the first level of firmness.

In the preferred embodiment, the invention provides an adjustable personal support apparatus for comfortably supporting a passenger in a motor vehicle, or any place where one may want to fall asleep in an upright or semi-upright seated position, that cradles the body and helps keep the sleeping wearer from falling to one side or another while sleeping. The support apparatus includes a generally U-shaped collar member and two side arm support members, which serve as arm rests and mold substantially to the body and the interior of the car. The collar member, while soft, is firm enough to retain its shape. The side arm support members are more malleable, allowing them to form to the passenger's body and the interior of the vehicle.

In an alternative embodiment, the U-shaped collar further comprises first and second head support lobes projecting from the top of the collar member for supporting the passenger's head from both sides when the head is tilted back.

The collar member fits around the user's neck from the back. The side arm support members are permanently or reversibly attached to the collar member, and hence to each other, such that the weight of the sleeping passenger's arms and friction of the body and other surfaces, such as the interior of a vehicle, on each side arm support member keep the entire device stable and upright. This gives the wearer a secure and comfortable feeling that is conducive to sleeping, as described in further detail below.

These and other features and advantages will become readily apparent from the following detailed description, which should be read in conjunction with the accompanying drawing figures.

DETAILED DESCRIPTION OF THE INVENTION

The following description relates to certain preferred embodiments of an adjustable device for supporting the head and body of a sleeping person, while seated in an upright or semi-upright position. It will be readily apparent that numerous variations and modifications other than those specifically indicated will be readily apparent to those of sufficient skill in the art. In addition, certain terms are used throughout the discussion in order to provide a convenient frame of reference with regard to the accompanying drawings, such as "upper", "lower", "top", "bottom", "front", "back", and the like. Such terms are not intended to be specifically limiting of the invention, except where so indicated in the claims.

The invention provides a device for supporting the head and body of a sleeping person, while seated in an upright or semi-upright position. The invention provides an adjustable personal support apparatus for comfortably supporting the passenger that cradles the body and helps keep the sleeping person from falling to one side or another while sleeping. The support apparatus includes a generally U-shaped collar member and two side arm support members, which serve as arm rests and mold substantially to the body and the interior of the car. The collar member, while soft, is firm enough to retain its shape. The side arm support members are more malleable, allowing them to form to the wearer's body and the interior of the vehicle or sides of the seat. All sections are either permanently attached or reversibly attachable to one another. The collar portion fits around the user's neck, from the back. Each side support section is attached to the back portion of the neck section. The side supports wrap under the arms and down the sides of the body. This cradles the body while allowing unencumbered seatbelt use. Baffles or stitched sections within each support arm may be used to help prevent stuffing from settling to the lower arms. In its preferred form, the U-shaped collar of the support apparatus further comprises first and second head support lobes projecting from the top of the collar member for supporting the wearer's head from both sides, when the head is tilted back.

Figure 1:
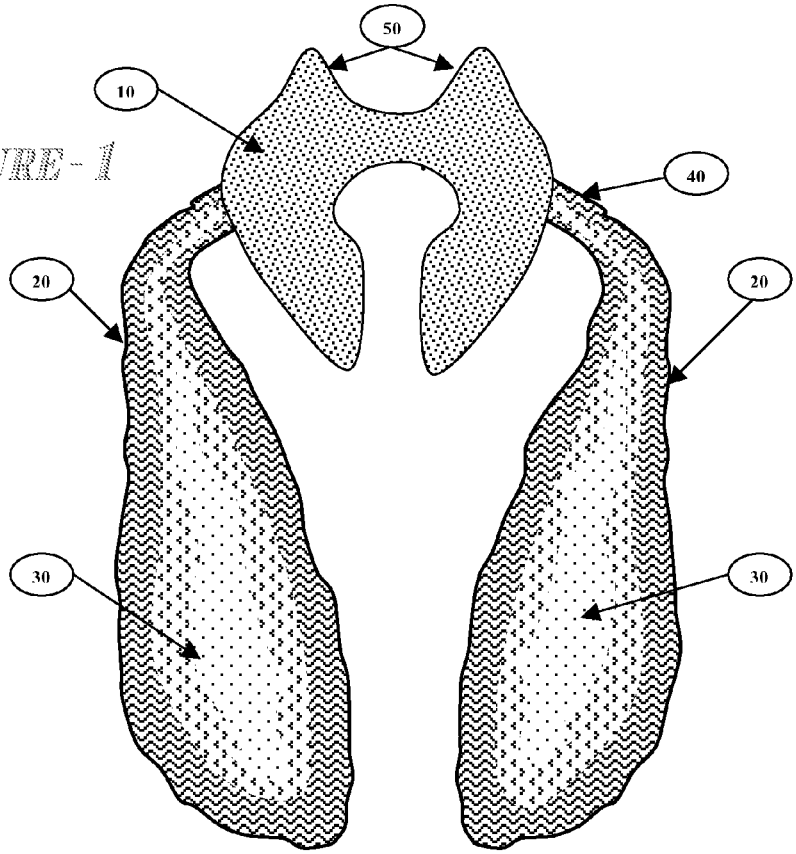
FIG. 1 is a front elevational view of an adjustable sleeping support apparatus according to an embodiment of the present invention.

Referring now to FIG. 1, a frontal view of an embodiment of the present invention is shown. The personal support apparatus comprises a generally U-shaped collar member 10 for contacting the wearer's neck from the back, with the collar 10 being made from a soft resilient material that retains its shape. First and second side arm support members 20 are permanently or reversibly and adjustably attached to the collar 10, with the side arm support members 20 being made from a soft malleable material that reversibly conforms to the contours of the passenger's body and/or the vehicle seat. The first and second side arm support members 20 preferably are characterized by a first level of firmness, and the collar member 10 preferably is characterized by a second level of firmness that is greater than the first level of firmness. The level of firmness of the various support members optionally is adjusted by the selection of one or more particular filling materials having different levels of firmness inherent therein, and/or by the selection of the amount of filling material(s) used. Optionally increasing the amount of filling material increases the level of firmness of the support member. Suitable filling materials include, but are not limited to, foam, beads, fiber, air, feathers, open-cell foam, closed-cell foam, foam rubber, polyurethane, polystyrene or any combination thereof. Optionally, numerous other known filling material can be used, such as, for example, straw. The lower part 30 of each side arm support member 20 is wider and thicker than the upper part 40 of the side arm support member, where it attaches to the collar member 10. The support arms optionally include stitching or baffles 100 to help keep loosely filled stuffing material from settling to one end. Preferably the U-shaped collar member 10 further comprises first and second head support lobes 50 projecting about an inch or two from the top/back area of the collar portion member 10 for supporting the passenger's head from both sides, when the head is tilted back. The side arm support members are permanently or reversibly attached to the collar member 10, preferably at the lower back side 70 of the collar 10.

The collar member 10 of the support apparatus preferably includes a substantially planar back side 60, that aids in preventing the collar member 10 from rolling to the side, and also helps keep the open end of the collar flat on the wearer's chest, when their head is lying back. The substantially planar back 60 also optionally is angled, such that the upper portion thereof extends back further toward the seat back or head rest, and the lower portion thereof angles inward 10-45 degrees toward the neck. This shape thus aids in retaining the collar member, allowing it to stay flatter on the wearer's chest and not spring up around the face, as many neck pillows are prone to do.

In one embodiment, the U-shaped collar member 10 further comprises first and second head support lobes 50 projecting one or two inches from the top of the collar member 10 for supporting the wearer's head from both sides, when the head is tilted back. The head support lobes 50 help keep the sleeping wearer's head from falling to the side, when the head is in the fully back position. The forward part of the collar member 10 helps to support the head from the front and side.

The collar member 10 should be made from of a soft material that retains its shape, still while being soft enough for comfortable use as a neck pillow. The side arm support members 20 are softer and less structured than the collar member 10. Each side arm support member 20 preferably is at least about twelve inches long, up to about three feet in length. Longer arms could be used, but would add little additional benefit. The upper portion 40 of each side arm member 20 attached to the collar member 10 is relatively thin, preferably being less than two to six inches in diameter. This upper portion 40 connects to the collar member 10 and wraps under each arm from the back. The lower portion 30 of each side arm support member 20 is more voluminous than its upper end 40. The uncompressed side arm members 20 preferably are between twelve and eighteen inches in diameter, while being able to compress down to approximately one to two inches, when fully compressed between the passenger and the seat or the interior of the vehicle or other surface.

The collar member 10 and side arm support members 20 can be filled with foam, beads, fiber, air, feathers, or any like substances suitable for use as stuffing for a pillow. In one embodiment, the collar member 10 and/or the side arm support members 20 are filled with a foam material. The foam material optionally is open-cell foam, closed-cell foam, foam rubber, polyurethane, or polystyrene. Optionally, the collar member 10 and side arm support members 20 are covered with a durable material, such as, for example, vinyl, plastic, fabric, leather, or rubber.

The collar member 10 is either permanently attached, or optionally, adjustably and reversibly attached to the first and second side arm support members 20, using standard attaching means, such as, for example, snaps, hooks, ties, buttons, and hook and loop fasteners.

Figure 2:
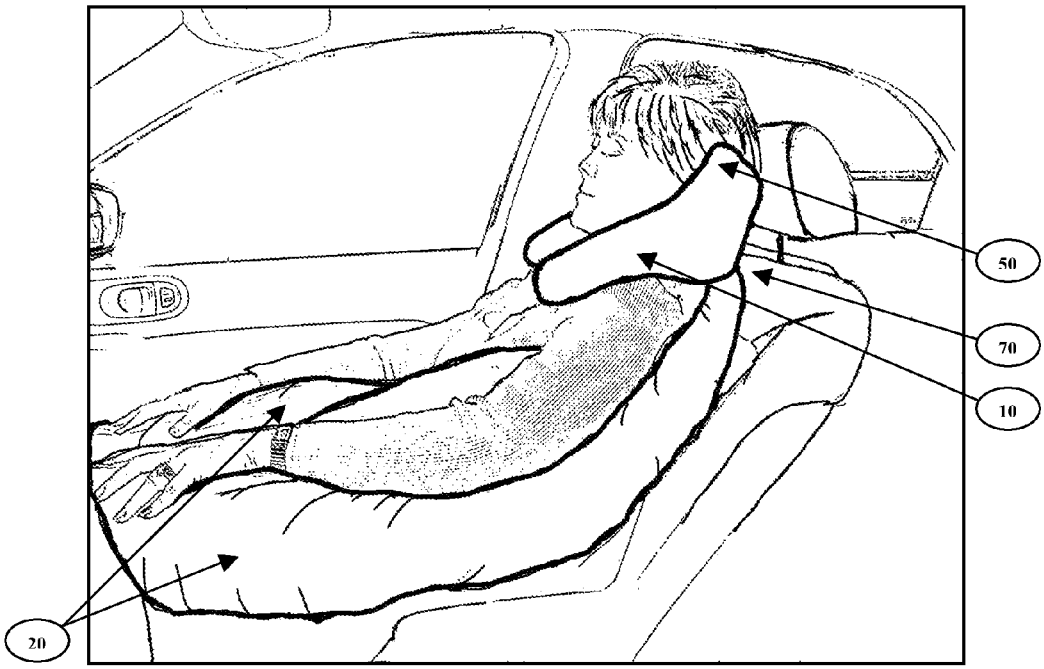
FIG. 2 is a side perspective view of an adjustable sleeping support apparatus according to an embodiment of the present invention.

FIG. 2 shows the personal support apparatus being used in an automobile. The collar member 10 fits around the neck from the back. The side arm support members 20 are attached to the collar 10 on the lower back area 70. When the passenger's head is back, the head support lobes 50 help to stabilize the head. Each side arm support member is attached to the back portion of the collar member 10. The side arm support members wrap under the passenger's arms and down the sides of the body. This cradles the body, while allowing unencumbered seatbelt use.

Figure 3:
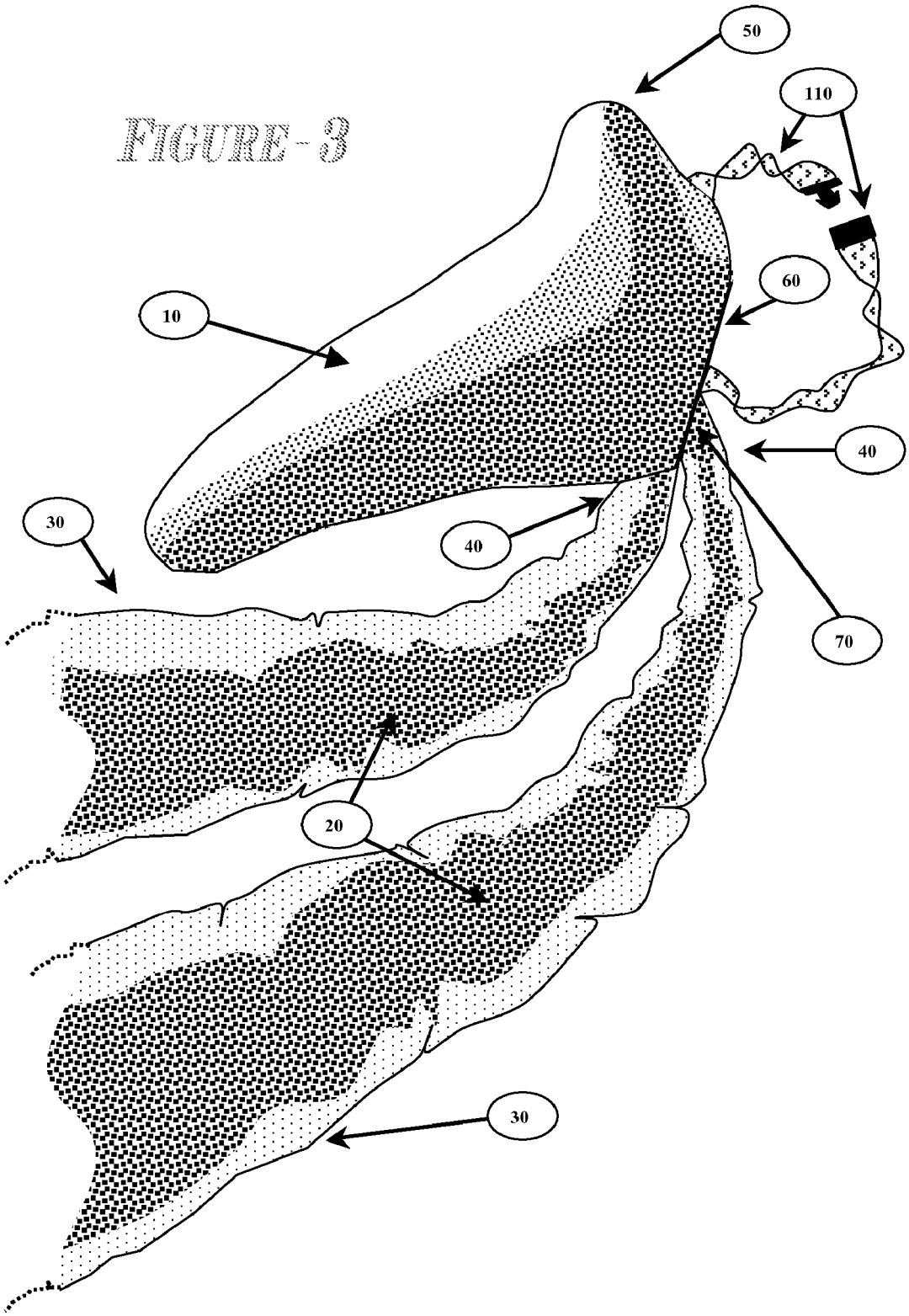
FIG. 3 is a side view of a collar portion of an adjustable sleeping support apparatus according to an embodiment of the present invention, showing part of the arms and where they attach. Also shown are optional straps for attaching the sleeping support apparatus to a seat.
Figure 4:
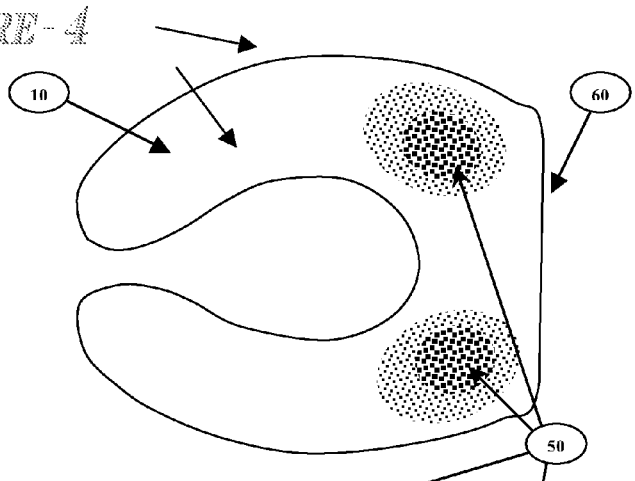
FIG. 4 is a top view of the collar portion of the adjustable sleeping support apparatus shown in FIG. 3.
Figure 5:
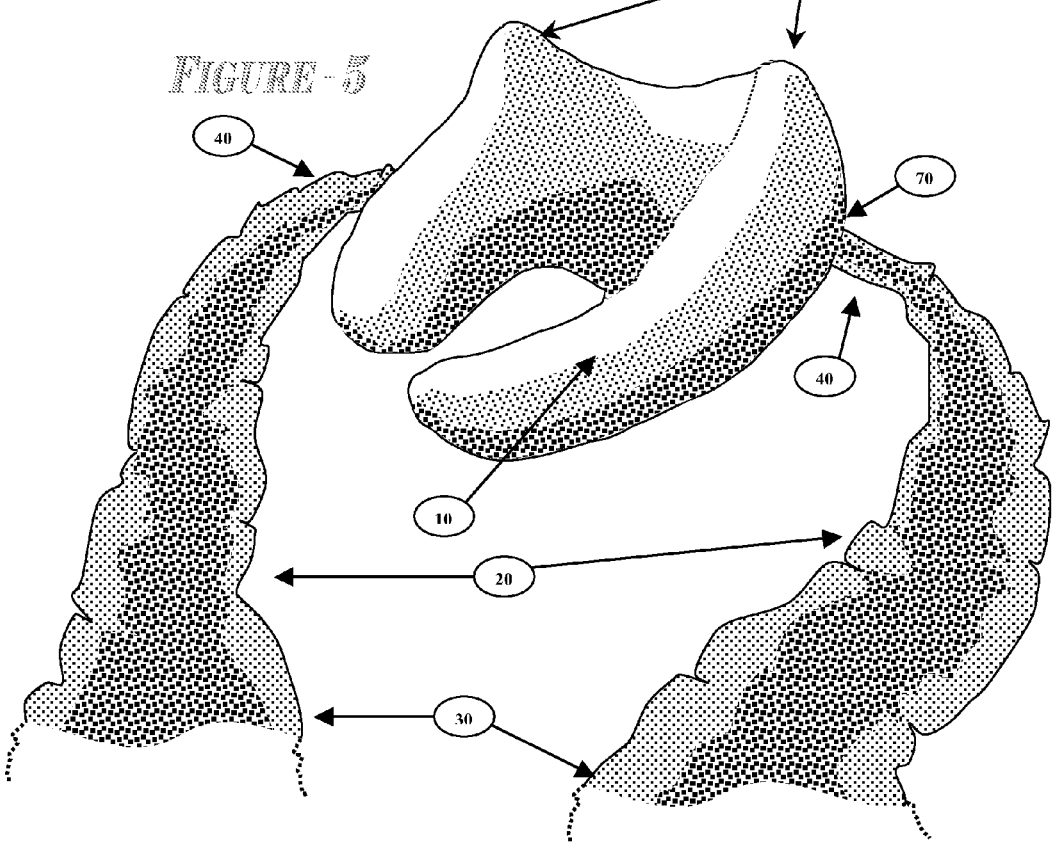
FIG. 5 is a perspective view of the collar and arms portion of the adjustable sleeping support apparatus shown in FIGS. 3 and 4.

FIGS. 3, 4 and 5 depict various views of the collar member 10 from different angles. FIG. 3 is a side view of the collar member 10 of the personal support device. FIG. 4 is a top view of the collar member 10 of the personal support device. FIGS. 3 and 4 clearly show the flattened and angled back 60 of the collar 10, as well as the general area where the arm pieces attach 70. FIG. 5 shows a perspective view of the collar member 10. FIGS. 3 and 5 also show the side arms as they are attached to the collar piece. FIG. 3 also shows where one or more optional straps 110 are attached, preferably to the back of the collar 10. The strap 110 secures the device to the back of the seat or headrest, allowing for increased stability. The straps 110 preferably include snaps, buckles, hook and loop fasteners, or are secured simply by tying to secure the two straps ends together.

Figure 6:
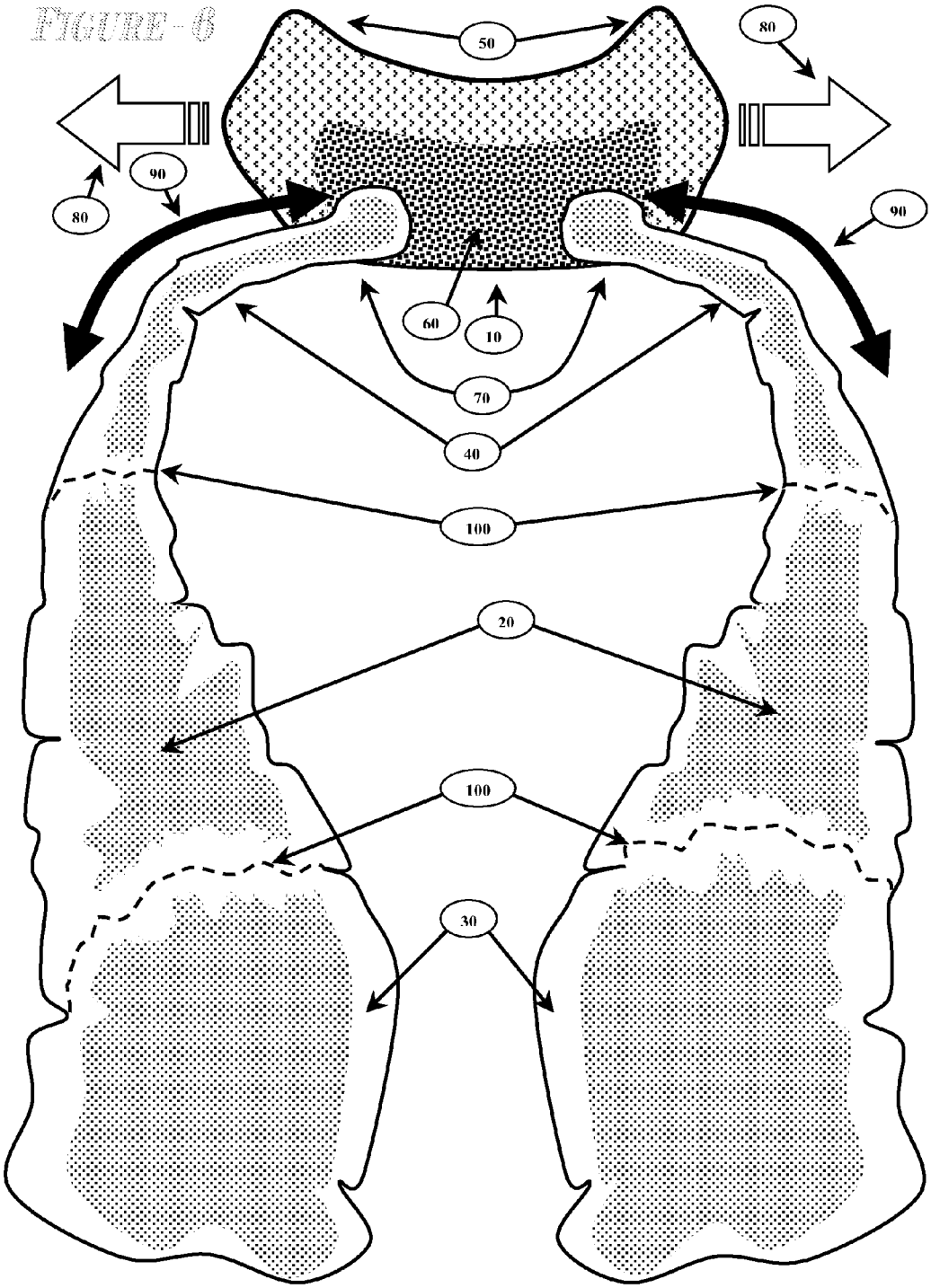
FIG. 6 is a view of the back of the device and shows where the arms attach to the collar piece. This figure also show how the arms hold the collar from moving from side to side.

FIG. 6 depicts the device from the back. This figure clearly shows where the side arms attach to the lower back of the collar 70. Collar movement in the directions of the large arrows 80 is minimized by the side arms pulling from each side as illustrated by the black arrows 90.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A personal support apparatus for supporting the head and body of a person sleeping in a seated position, comprising:

a substantially U-shaped collar member for contacting said person's neck from the back thereof, wherein said collar comprises a soft resilient material that retains its shape; and first and second side arm support members attached to said collar, wherein said side arm support members comprise a soft malleable material that reversibly conforms to the contours of said person's body and/or a seat or seating surface, and wherein said first and second side arm support members each are at least twelve inches in length;

wherein said substantially U-shaped collar member further comprises first and second head support lobes projecting from the top of said collar member for supporting said person's head from both sides; and wherein said first and second side arm support members are tapered, such that the width of each side arm support member increases from an upper end thereof attached to said collar, towards a lower end thereof.

2. The support apparatus of claim 1, wherein said first and second side arm support members each are between about twelve inches and about thirty-six inches in length.

3. The support apparatus of claim 1, wherein said substantially U-shaped collar further comprises a substantially planar rear side angled away from said person's head.

4. The support apparatus of claim 1, wherein said substantially U-shaped collar member and said first and second side arm support members are filled with independently selected foam, beads, fiber, air, feathers, open-cell foam, closed-cell foam, foam rubber, polyurethane, polystyrene or a combination thereof.

5. The support apparatus of claim 1, wherein said substantially U-shaped collar member is permanently attached to said first and second side arm support members, or wherein said substantially U-shaped collar member is reversibly attached to said first and second side arm support members by attaching means selected from the group consisting of snaps, hooks, ties, buttons, and hook and loop fasteners.

6. The support apparatus of claim 1, wherein said first and second side arm support members include stitching or baffles to hold said malleable material in place.

7. A personal support apparatus for supporting the head and body of a person sleeping in a seated position, comprising:

a substantially U-shaped collar member for contacting said person's neck from the back thereof, wherein said collar comprises a soft resilient material that retains its shape; and first and second side arm support members, each being between about twelve inches and about thirty-six inches in length and attached to said collar, wherein said side arm support members comprise a soft malleable material that reversibly conforms to the contours of said person's body and/or a seat or seating surface;

said first and second side arm support members being characterized by a first level of firmness, and said collar member being characterized by a second level of firmness that is greater than said first level of firmness;

wherein said first and second side arm support members are tapered, such that the width of each side arm support member increases from an upper end thereof attached to said collar, towards a lower end thereof.

8. The support apparatus of claim 7, wherein said substantially U-shaped collar member further comprises first and second head support lobes projecting from the top of said collar member for supporting said person's head from both sides.

9. The support apparatus of claim 7, wherein said substantially U-shaped collar further comprises a substantially planar rear side angled away from said person's head.

10. The support apparatus of claim 7, wherein said substantially U-shaped collar member and said first and second side arm support members are filled with independently selected foam, beads, fiber, air, feathers, open-cell foam, closed-cell foam, foam rubber, polyurethane, polystyrene or a combination thereof.

11. The support apparatus of claim 7, wherein said substantially U-shaped collar member is permanently attached to said first and second side arm support members.

12. The support apparatus of claim 7, wherein said substantially U-shaped collar member is reversibly attached to said first and second side arm support members by attaching means selected from the group consisting of snaps, hooks, ties, buttons, and hook and loop fasteners.

13. The support apparatus of claim 7, further comprising a cover made from a durable material selected from the group consisting of vinyl, plastic, fabric, leather, and rubber, and combinations thereof.

14. The support apparatus of claim 7, wherein said first and second side arm support members include stitching or baffles to hold said malleable material in place.

15. The support apparatus of claim 7, wherein said substantially U-shaped collar member is permanently attached to said first and second side arm support members, or wherein said substantially U-shaped collar member is reversibly attached to said first and second side arm support members by attaching means selected from the group consisting of snaps, hooks, ties, buttons, and hook and loop fasteners.

16. The support apparatus of claim 7, wherein said substantially U-shaped collar member further comprises first and second head support lobes projecting from the top of said collar member for supporting said person's head from both side, and said substantially U-shaped collar further comprises a substantially planar rear side angled away from said person's head.

17. The support apparatus of claim 7, wherein said substantially U-shaped collar member further comprises means for securing said support apparatus to a seat or headrest.

18. A method for supporting the head and body of a person sleeping in a seated position, comprising the steps of:

a) providing a personal support apparatus that includes i) a substantially U-shaped collar member for contacting said person's neck from the back thereof, wherein said collar comprises a soft resilient material that retains its shape; and ii) first and second side arm support members, each being between about twelve inches and about thirty-six inches in length and attached to said collar, wherein said side arm support members comprise a soft malleable material that reversibly conforms to the contours of said person's body and/or a seat or other surface, said first and second side arm support members being further characterized by a first level of firmness, and said collar member being characterized by a second level of firmness that is greater than said first level of firmness;

iii) said substantially U-shaped collar member being reversibly attached to said first and second side arm support members by attaching means selected from the group consisting of snaps, hooks, ties, buttons, and hook and loop fasteners;

b) providing a seat or seating surface; and c) positioning said personal support apparatus to support the head and body of said person sleeping in a seated position.

* * * * *